United States Patent [19]

Eanzel

[11] 3,969,073

[45] July 13, 1976

[54] DRY CLEANING ADDITIVE FOR DECREASING SOIL REDEPOSITION

[75] Inventor: Albert Robert Eanzel, Wilmington, Del.

[73] Assignee: E. I. Du Pont de Nemours and Company, Wilmington, Del.

[22] Filed: Jan. 20, 1975

[21] Appl. No.: 542,235

[52] U.S. Cl. ..... 8/142; 252/170; 252/171

[51] Int. Cl.[2] ..... D06L 1/04; D06L 1/08; C11D 7/52

[58] Field of Search ..... 252/89, 162, 171, 558, 252/554, DIG. 15; 8/142; 106/287 R

[56] References Cited

UNITED STATES PATENTS

| | | | |
|---|---|---|---|
| 2,621,193 | 12/1952 | Langkammerer | 260/414 |
| 2,621,195 | 12/1952 | Haslam | 260/414 |
| 2,628,170 | 2/1953 | Green | 106/271 |
| 2,628,171 | 2/1953 | Green | 106/271 |
| 2,824,114 | 2/1958 | Bostwick | 260/429.3 |
| 3,083,114 | 3/1963 | Gray | 106/271 |
| 3,091,508 | 5/1963 | Edwards | 252/171 |
| 3,352,790 | 11/1967 | Sugarman et al. | 252/171 |
| 3,707,508 | 12/1972 | Blomfield | 252/162 |
| 3,715,186 | 2/1973 | Anninos | 8/142 |
| 3,776,853 | 12/1973 | Minter et al. | 252/171 |
| 3,809,535 | 5/1974 | Neel | 8/142 |
| 3,813,221 | 5/1974 | Stubits | 8/142 |

*Primary Examiner*—P.E. Willis, Jr

[57] ABSTRACT

A dry cleaning composition comprising a dry cleaning solvent, a detergent and an organic ester of ortho-titanic acid and a process for its use which results in decreased soil redeposition.

4 Claims, 4 Drawing Figures

EXAMPLE 1

CONTROL

PHOSPHATE DETERGENT WITHOUT TITANATE ESTER

EXAMPLE 2

CONTROL

AEROSOL WITHOUT TITANATE ESTER

DRY CLEANING ADDITIVE FOR DECREASING SOIL REDEPOSITION

BACKGROUND OF THE INVENTION

In the dry cleaning of textiles, soil bound to the textile by a film of oil or grease is removed by dissolving the oil in a solvent. Additional benefits in dry cleaning are realized by the inclusion of dissolved detergent and a minor proportion of dissolved water to remove water-soluble soil as well as that bound to the fabric by oil and grease. The use of minor amounts of water in combination with detergent and solvent markedly decreases the percentage of garments requiring further treatment to remove stains after the dry cleaning process.

A continuing problem in dry cleaning operations is the prevention of redeposition of the soil removed from the textile. To this end, the dry cleaning solvent is generally filtered continuously during cleaning to remove the soil particles, and a portion of the filtered solvent is generally distilled after each load to remove dissolved oil and grease contaminants. During the cleaning operation itself, the detergents which have previously been used in the dry cleaning solutions tend to prevent redeposition of the soil onto the cleaned textiles. However, the detergents used in the past have not been entirely satisfactory, and the dry cleaning industry is continually seeking improvements in dry cleaning compositions which will result in faster and more thorough cleaning and which will more effectively prevent redeposition of the removed soil.

SUMMARY OF THE INVENTION

The present invention provides a dry cleaning composition and a process for its use which results in a marked reduction in soil redeposition on fabrics during cleaning as well as improved cleaning efficiency.

Specifically, there is provided, in a textile cleaning composition comprising textile dry cleaning organic solvent, dry cleaning detergent and optionally a minor amount of water, the improvement wherein the composition further comprises about from 0.01 to 0.3 weight percent of at least one organic ester of ortho-titanic acid.

The present invention further provides an improvement in the process of agitating textile material in a bath of textile dry cleaning organic solvent, dry cleaning detergent and optionally a minor amount of water; separating the textile material from the bath; and drying the textile material; the improvement comprising including in the bath an effective amount, and preferably about from 0.01 to 0.3 weight percent, of organic ester of ortho-titanic acid.

DETAILED DESCRIPTION OF THE INVENTION

Figure 1:
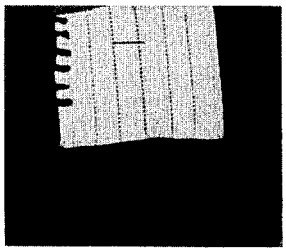
FIGS. 1 –4 are photographs of test swatches resulting from use of the present invention and control experiments.

The dry cleaning solvent of the present invention can include any of the solvents normally used for this purpose, including perchloroethylene, trichloroethylene, Stoddard Solvent, methylchloroform and trichlorotrifluoroethane. Similarly, the detergents used in the present invention can be of the type generally used in dry cleaning processes. These can include the amine salts of sulfated long chain alcohols which were earlier in common use in the dry cleaning industry, as well as the reaction products of ethoxylated alcohols or phenols with phosphorus pentoxide. Detergents prepared by ethoxylation of alcohols, amines, carboxylic acids, amides and alkylphenols can also be used. Still other detergents which can be used include 1-alkanesulfonates, alkylarylsulfonates, fatty acid sulfonates and the like. In the preparation of dry cleaning baths, the detergent is generally present in a concentration of about from 0.1 to 2.0 percent by weight of the cleaning bath.

The titanate esters used in the present invention can be any of the derivatives of ortho-titanic acid, $Ti(OH)_4$, ranging from highly reactive tetraalkyl titanates such as tetraisopropyl titanate to stable chelated esters. Both chelated and unchelated forms have been found beneficial in the present dry cleaning compositions.

Representative unchelated titanium esters which can be used are alkyl titanates of the formula $Ti(OR)_4$ where R is alkyl, aryl or cycloalkyl. Compounds of this group which are particularly convenient to prepare and use are the alkyl derivatives where R is alkyl of from 3 to about 18 carbon atoms. They can be formed by reacting titanium tetrachloride with an alcohol in the presence of a base such as ammonia.

Other representative unchelated titanium esters are titanium acylates of the formula $Ti(OCOR)_{4-n}(OR)_n$ where R is as defined above and $n$ is 0 to 3. While tetraacylates can be prepared, they decompose slowly at room temperature to give the acid anhydride and polytitanyl diacylates of the formula

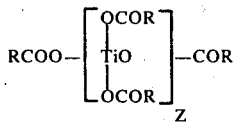

where Z is an indeterminate number. Hydroxypolytitanyl acylates can also be prepared using known techniques by the reaction

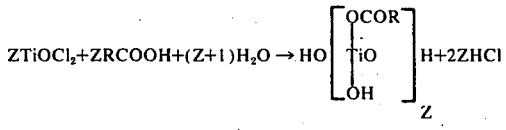

Of these acylates the polyhydroxy titanium alkanoates where R is alkyl of 12 to 18 carbon atoms have been found particularly satisfactory.

Chelated titanate esters useful in the present invention can be prepared by coordinate bonding between titanium and electron-donating atoms such as oxygen or nitrogen. When alkyl esters of titanic acid are formed from amino alcohols, keto alcohols or glycols as the ligands, the hydroxyl groups of two moles of the ligand replace two alkoxy groups of the ester and a stable five or six member ring structure is formed by donation of electrons from oxygen or nitrogen to titanium. These chelates can be represented by the general formula

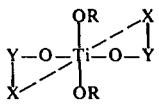

where X represents the electron donon atom (oxygen or nitrogen) and Y represents a two or three atom carbon chain, so that a five or six membered ring can be formed. R can be alkyl or can be identical with the ligand represented by X—Y—OH. Chelated esters can be formed in both aqueous and nonaqueous systems. The titanium chelate esters preferred for use in the present invention are the acetylacetonate ester, triethanolamine titanate, and tetraoctyleneglycol titanate. The chelated esters are usually prepared by heating a tetraalkyl titanate with an amino alcohol, a keto alcohol or a glycol, with the coordinating substituent located so as to form a five or six membered ring. A representative reaction is

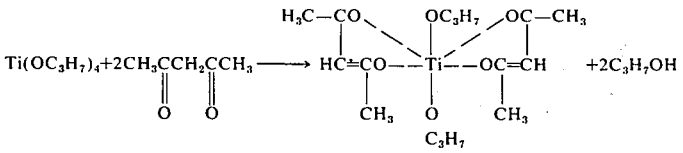

The more reactive titanate esters such as tetraisopropyl titanate hydrolyze in moist air. The end product of titanate ester hydrolysis is titanium oxide, but various intermediate compounds are usually formed before hydrolysis is complete. In some cases partial polymerization, with links between titanium atoms, can occur. Accordingly, the more reactive titanate esters should be protected from moist environments prior to formulation of the dry cleaning composition for maximum effectiveness.

Many titanate esters are commercially available and, of those, the following have been found especially valuable for improving detergent performance in dry cleaning operations:

tetraisopropyl titanate
tetrabutyl titanate
tetrakis (2-tehylhexyl) titanate
tetrastearyl titanate
titanium acetylacetonate
triethanolamine titanate
tetraoctyleneglycol titanate These compounds can be prepared as disclosed in the literature. Synthesis of the alkyl titanates is found in "The Organic Chemistry of Titanium" by Feld and Cowe, published by Butterworth & Co., Washington, D.C. (1965). Tetrastearyl titanate is prepared as disclosed by Haslam in U.S. Pat. No. 2,621,195. The titanium acetylacetonate preparation is found in British Pat. No. 734,113; the triethanolammonium titanate in Bostwick, U.S. Pat. No. 2,824,114; and the tetraoctyleneglycol titanate in Bostwick, U.S. Pat. No. 2,643,262.

In the preparation of dry cleaning compositions, the titanate ester is admixed with the dry cleaning solvent, the detergent and any water present. Generally, the titanate ester should comprise at least about 0.01% by weight of the total dry cleaning composition, since amounts less than this exhibit little or no improvement in soil redeposition characteristics. Little or no additional improvement in the performance of the dry cleaning compositions is realized with greater than 0.3% by weight of the cleaning bath of titanate ester. Accordingly, it is preferred to limit the concentration of the titanate ester to this amount for economic considerations.

The present compositions can also tolerate minor amounts of water brought into the bath by the textiles themselves or through the use of pre-spotting compositions. Quantities of water is excess of about 1.5 weight % will generally depreciate the desirable effect of the titanate ester.

Other additives commonly used in dry cleaning baths can also be present in the instant compositions without detracting from the beneficial effects of the titanate ester. Textile softeners, anti-bacterial chemicals, bleaching agents, anti-static agents, brightening agents and repellents are representative of such additional components.

The present compositions can be used in standard dry cleaning operations without modification. In a typical process, the textiles to be cleaned and the dry cleaning composition are agitated together for a period of about 5 to 30 minutes, after which the dry cleaning composition is drained away and residual solvent removed, usually by centrifuging. A solvent rinse would then follow, with the removal of solvent as before. Finally, the textiles are tumble dried with warm air. Using the present compositions, no alteration of the normal cycle for filling, agitation, solvent removal or drying is required.

The dry cleaning compositions in the process of the present invention result in efficient dry cleaning combined with remarkably improved soil redeposition characteristics. The present dry cleaning compositions are applicable to dry cleaning processes where oil and water repellents such as wax and polyfluoro repellent materials are incorporated into the dry cleaning liquid to be deposited on the textiles. The mechanism by which the titanate esters improve cleaning efficiency is not fully understood, but is common to all titanate esters.

The invention is further illustrated in the following specific examples. In these examples, the cleaning performance of the textile cleaning compositions was evaluated using a test method widely used in the dry cleaning industry. A piece of clean woolen cloth is caused to absorb soil of known composition. The soiled wool is then subjected to dry cleaning in the presence of a swatch of six strips of clean white fabric, the strips being respectively acetate rayon, cotton, nylon, polyester, polyacrylic and wool. Each strip is about 5 cm. by 0.64 cm. After dry cleaning under controlled conditions, soil will have been removed from the soiled woolen cloth and some of the soil removed will have been deposited on the various fabric strips. It is desired to remove the soil from the woolen cloth and to keep it suspended in the cleaning fluid, maintaining the test trips in their original unsoiled condition as nearly as possible. The amount of soil used is considerably more than would normally be present in soiled garments, in order to emphasize differences in performance and make it possible to evaluate the methods and materials tested. Comparisons are made visually, but are not easily graded by reflectance measurements, partly because of the varying surface characteristics of the different fabrics.

A standard soil was prepared from 60 grams Germantown Lamp Black, 180 grams "Crisco" commercial hydrogenated vegetable oil, 258 grams "Nujol" commercial medicinal paraffin oil, and 120 grams wheat starch.

The wheat starch was screened through a 200 mesh sieve (79 mesh per cm., openings - 0.074 mm.) and was thoroughly mixed with the lamp black and the "Crisco" heated to 37.8°C. The "Nujol" at a temperature of 37.8°C. was added and mixing continued until the mixture was homogenous. Then 150 grams of the prepared soil was mixed with perchloroethylene to make a total of 5 liters.

In the testing procedure used in Examples, 10.2 cm. by 10.2 cm. wool flannel test pieces were soiled by soaking in the perchloroethylene-soil composition, then wrung out to 150% wet pick-up (cloth contained 150% of its dry weight of the fluid mixture) and allowed to dry at room temperature.

In testing the cleaning effectiveness of the compositions of the Examples, 25 stainless steel balls about 0.64 cm. in diameter were placed in a Launder-Ometer jar, and 100 ml of the prepared cleaning solution to be tested was measured into the jar. When water was added, the water and cleaning solution were mixed in a high speed mixer for 30 seconds before adding to the jar. Into the jar of cleaning solution were placed one soiled woolen test piece and one six-fiber test swatch. The jar was secured in the Launder-Ometer and agitated for 15 minutes, then opened and the swatch and woolen piece removed.

Both the soiled test piece swatch and the six-fiber test were rinsed by dipping in clean perchloroethylene until the solvent remained clear, in order to remove unabsorbed surface soil. They were then spun in a small centrifuge for 30 seconds to remove free solvent, placed on clean paper towels and allowed to dry at room temperature.

Comparisons were made visually. Some of the six-fiber test swatches were graded according to the following scale:

5 = no visible deposition
4 = light surface deposition
3 = appreciable deposition
2 = considerable deposition, dark
1 = heavy deposition The originally soiled woolen piece was graded on a similar number system where 5 = negligible or no soil remaining
4 = slightly soiled
3 = noticeably soiled
2 = considerably soiled
1 = heavily soiled - little effect of cleaning

EXAMPLE 1

A dry cleaning composition was prepared by admixing 100 ml of perchloroethylene dry cleaning solvent, 0.1% titanate ester and 0.2% detergent. The titanate ester used was tetrakis (2-ethylhexyl) titanate. The detergent was the diethanolamine salt of mixed mono- and di-6-18 carbon alkyl esters of orthophosphoric acid. A control cleaning composition was compared having the same formulation, but without the titanate ester.

The cleaning compositions of Example I and the control were used to clean fabric swatches in accordance with the procedures described above. The resulting swatches were evaluated, and the results of the evaluation are presented in Table I below.

TABLE I

| Fabric Type | Example 1 | Control (Without Titanate) |
|---|---|---|
| Rayon | 4 | 3 |
| Cotton | 4 | 3 |
| Nylon | 5 | 4 |
| Polyester | 4 | 1 |
| Polyacrylic | 5 | 2 |
| Wool | 5 | 3 |

Figure 2:
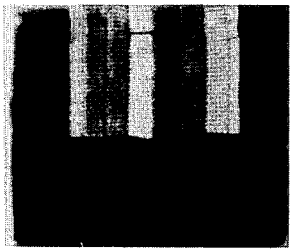

Photographs of the test swatches resulting from the experiments appear as FIGS. 1 and 2 for the swatch resulting from the present invention and the control, respectively.

EXAMPLE 2

The procedure of Example 1 was repeated, except that the titanate ester used was an 80%/20% by weight mixture of tetraisopropyl and tetrastearyl titanate, and the detergent used was "Aerosol"OT (sodium dioctylsulfosuccinate).

Figure 3:
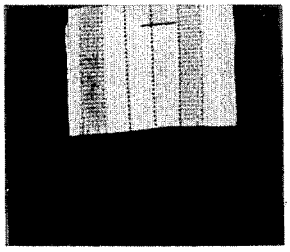
Figure 4:
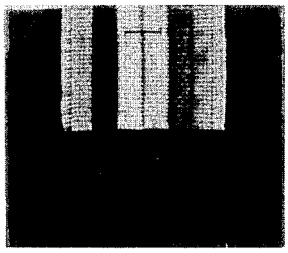

The results of the grading are presented in Table II below, and photographs of the swatches resulting from the experiments appear as FIGS. 3 and 4, for the swatches of Example 2 and the control experiment, respectively.

TABLE II

| Fabric Type | Example 2 | Control (Without Titanate) |
|---|---|---|
| Rayon | 3 | 3 |
| Cotton | 5 | 1 |
| Nylon | 5 | 4 |
| Polyester | 5 | 4 |
| Polyacrylic | 4 | 3 |
| Wool | 5 | 3–4 |

EXAMPLES 3 to 6

In Examples 3 to 6, dry cleaning compositions were prepared from perchloroethylene and 1% by weight of "Aerosol" OT dry cleaning detergent commercially available from American Cyanamid Company. In Examples 3, 4 and 5, 0.2% by weight of titanate ester was added, the titanate esters being tetraisopropyl titanate, tetraisobutyl titanate and poly(tetraacetyl) titanate, respectively. In Example 6, 0.15% of titanium diisopropylate diacetylacetonate was used. Control cleaning compositions were prepared which were identical except that the titanate esters were omitted.

The cleaning compositions of the invention and the control cleaning compositions were tested and graded according to the standard procedures described above. The cleaning compositions in all cases exhibited less redeposition of soil on all six types of fabric used in the test swatches when compared to the control cleaning compositions without the titanate ester.

EXAMPLES 7 to 11

In Examples 7 to 11, dry cleaning compositions were prepared from perchloroethylene and 1% by weight of "Adco Dri Sheen", commercially available from Adco Corporation, Sedaba, Missouri. Table 3 illustrates the type and quantity of titanate ester used in the several examples.

TABLE III

| Example | Titanate Ester | Weight % |
|---|---|---|
| 7 | tetrakis (2-ethylhexyl) titanate | 0.2 |
| 8 | tetrabutyl titanate | 0.2 |
| 9 | titanium di-isopropylate distearate | 0.2 |
| 10 | titanium di-isopropylate di(triethanolamine) | 0.16 |
| 11 | titanium diisopropylate diacetylacetonate | 0.15 |

Control cleaning compositions were prepared which were identical except that no titanate ester was included. The cleaning compositions were tested and the resulting samples graded as before. In Example 11, the cotton strip on the test swatch retained more redeposited soil using the cleaning composition of the present invention than did the cotton strip using the control composition. In all other fabrics tested in Example 11 and in all fabrics tested in Examples 7 to 10, the test swatches had less redeposited soil than those resulting from the control cleaning compositions.

EXAMPLES 12 to 15

In Examples 12 to 15, a cleaning composition was prepared using perchloroethylene and 1 % by weight "Sanitone" 8870, commercially available from Emery Industries, Cincinnati, Ohio. The titanate esters used and their quantity are shown in Table IV.

TABLE IV

| Example | Titanate Ester | Weight % |
|---|---|---|
| 12 | tetraisopropyl titanate | 0.2 |
| 13 | tetrabutyl titanate | 0.2 |
| 14 | titanium diiso-propylate diacetyl-acetonate | 0.15 |

TABLE IV-continued

| Example | Titanate Ester | Weight % |
|---|---|---|
| 15 | tetrakis(2-ethyl-hexyl) titanate | 0.2 |

Upon testing and grading as described above, every test strip exhibited less redeposition using the cleaning composition of the present invention than with the control composition without titanate ester.

EXAMPLES 16 to 18

The general procedure of Examples 7 to 11 was repeated using 1% Streets 886 detergent, commercially available from R. R. Street, Oak Brook, Illinois, in combination with tetrakis(2-ethylhexyl) titanate, tetrabutyl titanate and tetraisopropyl titanate. In all cases, the test swatches resulting from the present invention were cleaner than the control experiments in which the titanate ester was omitted.

I claim:

1. A textile cleaning composition comprising textile dry cleaning organic solvent and, by weight of the cleaning composition, about from 0.1% to 2.0% of dry cleaning detergent and about from 0.01% to 0.3% of organic ester of ortho-titanic acid.

2. A dry cleaning composition of claim 1 wherein the organic ester of ortho-titanic acid is selected from the group consisting of tetraisopropyl titanate, tetrastearyl titanate, tetrakis(2-ethylhexyl) titanate, tetrabutyl titanate and titanium diisopropylate diacetylacetonate.

3. A textile cleaning composition of claim 1 further comprising up to about 1.5% water, by weight of the cleaning composition.

4. In a process of agitating textile material in a dry cleaning composition comprising textile dry cleaning organic solvent and about from 0.1% to 2.0%, by weight of the dry cleaning composition, of dry cleaning detergent; separating the textile material from the bath; and drying the textile material; the improvement comprising including in the composition about from 0.01% to 0.3% by weight of the composition of organic ester of ortho-titanic acid.

* * * * *